United States Patent [19]

Edwards et al.

[11] Patent Number: 4,894,118

[45] Date of Patent: Jan. 16, 1990

[54] RECREPED ABSORBENT PRODUCTS AND METHOD OF MANUFACTURE

[75] Inventors: Steven L. Edwards, Fremont; William D. Lloyd, Neenah, both of Wis.

[73] Assignee: Kimberly-Clark Corporation, Neenah, Wis.

[21] Appl. No.: 894,371

[22] Filed: Aug. 6, 1986

Related U.S. Application Data

[63] Continuation-in-part of Ser. No. 755,147, Jul. 15, 1985, abandoned.

[51] Int. Cl.[4] ..... D21H 5/24

[52] U.S. Cl. ..... 162/112; 162/113; 162/147

[58] Field of Search ..... 162/111-113, 162/281, 147

[56] References Cited

U.S. PATENT DOCUMENTS

| | | | |
|---|---|---|---|
| 3,017,317 | 1/1962 | Voigtman et al. | 162/111 |
| 3,163,575 | 12/1964 | Nobbe | 162/281 |
| 4,166,001 | 8/1979 | Dunning et al. | 162/111 |
| 4,302,282 | 11/1981 | Young | 162/281 |
| 4,482,429 | 11/1984 | Klowak | 162/111 |

FOREIGN PATENT DOCUMENTS

| | | | |
|---|---|---|---|
| 2501742 | 9/1982 | France | 162/113 |

*Primary Examiner*—Peter Chin

*Attorney, Agent, or Firm*—Gregory E. Croft

[57] ABSTRACT

There has been provided a recreped absorbent product manufactured by forming a web from an aqueous stock, drying the web to a selected consistency and creping one side thereof. The creped web is then conveyed at a selected rate for drying and recreping on the same side. The web moisture consistency, draw speeds, crepe angle and nip pressures as well as crepe adhesive qualities are controlled parameters.

25 Claims, 1 Drawing Sheet

RECREPED ABSORBENT PRODUCTS AND METHOD OF MANUFACTURE

This is a continuation-in-part of co-pending application Ser. No. 755,147 filed on July 15, 1985 abandoned.

BACKGROUND OF THE INVENTION

Absorbent disposable tissue and towel products have recently become increasingly softer and smoother, while retaining or increasing their absorbent capacity. Consumers have become increasingly more conscious about the tactile properties of such products, which include facial and bathroom tissue, and household and industrial towels and wipers. It is also to be understood that a single creped product while acceptable for many wiping purposes in the past, suffers in comparison to product made in accordance with many of the current papermaking technologies which produce tissues having a significantly increased consumer perception of softness and smoothness. Therefore, a number of processes have been proposed to produce products having increased softness and smoothness coupled with adequate absorbency characteristics as set forth in Canadian Patent No. 1,176,886, issued October 30, 1984 to Nuttall and assigned to the Assignee herein.

In said Canadian patent, there is disclosed a process for the manufacture of a soft absorbent disposable paper product which is twice creped on either or both sides. The present invention represents an improvement over the aforementioned process wherein greater control, and a more precise definition of process parameters has been achieved thereby resulting in an improved product at a lower manufacturing cost. It should be understood that the teachings of the Canadian patent are incorporated herein by reference.

SUMMARY OF INVENTION

There has been provided a recreped absorbent product manufactured by forming a web from an aqueous stock, drying the web to a selected consistency and creping one side thereof. The creped web is then conveyed at a selected rate for drying and creping on the same side. The web moisture consistency, draw speeds, crepe angle and nip pressures as well as crepe adhesive qualities are controlled parameters.

DESCRIPTION OF THE PREFERRED EMBODIMENT

Figure 1:
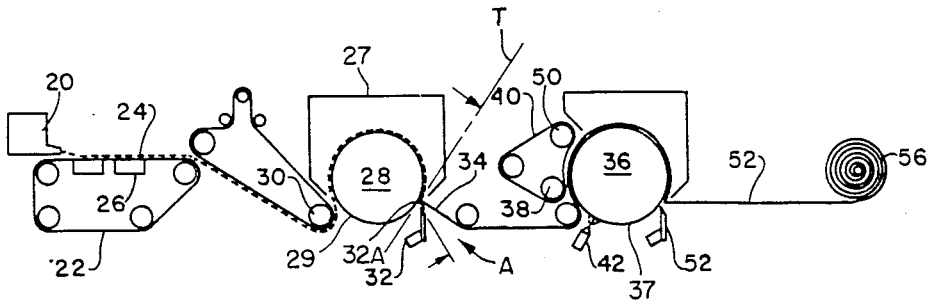
FIG. 1 is a schematic representation of an embodiment of the present invention.

The process of the present invention may be carried out on apparatus as shown in FIG. 1 which apparatus is generally known in the art of papermaking. A slurry of papermaking fibers is deposited from headbox 20 onto forming wire 22. The web 24 formed thereby is partially dewatered by conventional means, such as vacuum boxes 26 prior to being affixed to a first, preferably cylindrical, dryer 28 such as a Yankee dryer. Such a dryer 28 typically includes a vapor hood 27 and drying cylinder 29 for carrying the web. Other dryers hereinafter described include similar components. The web 24 may be affixed to the first dryer 28 by means of a pressure roll 30, which compresses the web against the cylinder 29 with a force of approximately 300–500 pli for a wet processed web. The web when affixed to the first dryer 28 has a fiber consistency of approximately 38% which is increased to at least 90% upon being removed from the dryer. The web is drawn or conveyed through dryer 28 at a first selected dryer speed and creped by doctor blade 32, resulting in a creped web 34. The doctor blade has a crepe angle of between 60 and 100 degrees, but preferably between 70 and 80 degrees. The crepe angle A is the angle between the ground surface 32A of the blade 32 and the tangent T to the cylinder 29 at the point of contact. Depending upon the consistency of the web at the point of application to the dryer 28, it may be necessary to apply adhesive to insure proper adhesion between the web and the dryer.

The creped web 34 is conveyed to a second dryer 36 having cylinder 37 similar to the first dryer 28 and is affixed thereto at a pressure nip formed between pressure roll 38 and cylinder 37. The nip pressure loading is about between 50 and 300 pli and preferably 100–200 pli. An imprinting fabric 40 is passed around pressure roll 38 so that the creped web 34 is impressed against cylinder 37 in a pattern corresponding to the raised knuckle areas of imprinting fabric 40. In order to assure that proper adhesion is effected between the knuckled areas of fabric 40 and dryer 36, the fabric 40 may be wrapped about a portion of the cylinder 37 between pressure roll 38 and roll 50. It has been found that imprinting fabrics in the range of from about 20 meshes/in$^2$ to about 200 meshes/in$^2$ are acceptable for this purpose, with a preferred range of 50–100 mesh/in$^2$. The tissue web 34 is conveyed through dryer 36 at a second dryer speed, creped on the same side by doctor blade 54, and rolled into a roll of finished product 56.

The ratio of the first dryer speed is the second dryer speed in a draw rate of about 1.05 to about 1.25 and preferably 1.05 to 1.15.

Adhesives may be required to adhere the web 34 to cylinder 37. An overall adhesive may be applied preferably by sprayer 42 either to the web 34 or cylinder 37. The sprayer 42 contains active adhesive of less than 1% and preferably between 0.2 and 0.6%. The adhesive is at a concentration of 0.2–1% solids and preferably 0.4–5%. The adhesive may also be applied by a conventional rotogravure roll (not shown). Adhesives suitable for such use may be polyvinyl acetate or polyvinyl alcohol. The adhesive may be mixed with a wet strength additive such as a material sold under the tradename Kymene 557 by Hercules Co. Also, tack modifiers such as sold by Rohm and Haas under the tradename Tritron X100 or Sorbitol liquid sugar sold by Pfizer may be used in combination with the adhesive.

Additionally, while the present invention finds particular application to a process whereby a web is produced from a furnish comprising cellulose fibers, such a web could be produced from a furnish comprising a combination of cellulosic and noncellulosic textile fibers.

It has been found that enhanced quality of the second crepe is surprisingly high even when using 100% secondary fiber furnish. For example, if softness is measured on a scale of 1–10, the difference between the first and second crepe of a web formed from high quality material may be as low as 0.5 on the scale. However, when using 100% secondary material, the difference in softness may approach 4 points. Further, the difference between the two twice creped products may be less than a whole point. Thus, a high quality product may be produced using a relatively inexpensive furnish.

In order to illustrate the surprisingly beneficial results using secondary fiber furnishes, comparative data were gathered from pilot plant runs producing one-ply and two-ply recreped facial tissue from different furnishes. For purposes herein "secondary fiber" means fiber recovered from other paper products. The fiber may be used directly or may be washed and screened to remove undesirable component such as ash, ink, sizing agents, polymers, etc. Secondary fiber is typified by having been previously used at least once to manufacture a paper product. It typically has a lower freeness, higher percentage of damaged fiber, higher fines content, an uncontrolled fiber species mix, higher ash content and other contaminants. A secondary fiber furnish contains a significant amount of secondary fiber, generally about 20 weight percent or greater.

Table I contains averaged results from many different samples comparing the effect of furnish on the softness of recreped products as compared to conventional, once creped products.

TABLE I

| Furnish | Product | Average Normalized Softness |
|---|---|---|
| Secondary Fiber | 2 ply conventional | 6.5 |
| | 2 ply recreped | 7.7 |
| Regular | 2 ply conventional | 7.6 |
| | 2 ply recreped | 7.6 |
| Premium | 2 ply conventional | 8.6 |
| | 2 ply recreped | 8.8 |

These results illustrate that the greatest advantage of recreping lies in producing product furnishes containing secondary fiber, in which softness gains increased on average of 1.2 points (18%) over conventional products containing secondary fiber. Products made from regular furnishes showed no change. Products made from premium furnishes showed only a 0.2 point softness increase (2%).

Table II shows the maximum softness gains obtained for two ply products, having a basis weight of 14 to 17 gsm per ply, as a function of the percentage of secondary fiber in the furnish. A "regular" furnish consists primarily of virgin chemical wood pulp from North American wood species. It is typically a mixture of hardwood and softwood kraft pulps from North American wood species or from species having similar morphological characteristics.

A "premium" furnish has eucalyptus fiber or its equivalent present as a significant portion of the furnish (approximately 20% or more).

TABLE II

| Furnish | Product | Softness |
|---|---|---|
| 25% Secondary Fiber | 2 ply conventional | 6.7 |
| | 2 ply recreped | 7.7 |
| 40% Secondary Fiber | 2 ply conventional | 8.1 |
| | 2 ply recreped | 10.3 |
| 60% Secondary Fiber | 2 ply conventional | 6.2 |
| | 2 ply recreped | 9.5 |
| 100% Secondary Fiber | 2 ply conventional | — |
| | 2 ply recreped | 7.8 |

As illustrated above, the softness of the recreped product was substantially increased relative to the conventional product for all levels of secondary fiber addition. At the 25% level, the softness improvement was 1.0 point (15%); at the 40% level, the softness improvement was 2.2 points (27%); at the 60% level, the softness improvement was 3.3 points (53%). No comparative data were available for a 100% secondary fiber conventional product.

Table III contains results similar to those of Table II, except the product was a single ply product having a basis weight of 22 to 29 gsm.

TABLE III

| Furnish | Product | Softness |
|---|---|---|
| 25% Secondary Fiber | 1 ply conventional | 1.4 |
| | 1 ply recreped | 4.4 |
| 40% Secondary Fiber | 1 ply conventional | — |
| | 1 ply recreped | 5.4 |
| 100% Secondary Fiber | 1 ply conventional | — |
| | 1 ply recreped | 2.0 |

The results show a substantial softness improvement of 3.0 points (215%) at the 25% secondary fiber level. Although direct comparative data are not available at the 40% and 100% secondary fiber levels, it is believed that significant increases in softness are also obtained. When compared to the results of Table II, these results also point out the significantly higher softness levels achievable with a 2 ply product form relative to a 1 ply product form.

All of the foregoing results illustrate marked improvements in softness for recreped secondary fiber furnishes.

Figure 2:
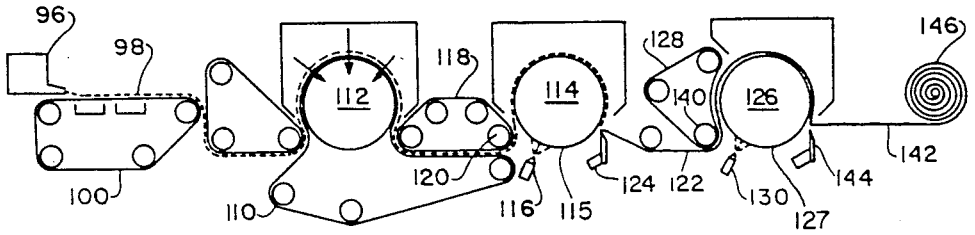
FIG. 2 is a schematic representation of another embodiment of the present invention.

The current invention may also produce significant benefits when utilized with a "throughdrying" machine as shown in FIG. 2. A machine of this type may include, for example, headbox 96 which lays a web 98 of papermaking fibers on forming wire 100. The web 98 is transferred to a throughdrying fabric 100 which carries the web around a through-air drying cylinder 112, with the web 98 being thermally predried to a consistency of approximately 90% B.D. The thermally predried web is thereafter transferred to dryer 114 and adhered to cylinder 115 thereof with the addition of creping adhesives from sprayer 116 as necessary. The web is preferably adhered to the dryer 114 by impressing plane nip roll 120 against the cylinder 115. The web may also be impressed against the cylinder 115 by raised knuckle areas of an imparting fabric 118 at the location of the pressure roll 120. The web 122 is creped from cylinder 115 by doctor blade 124 and carried to a second dryer 126 having cylinder 127 and differentially adhered thereto by imprinting fabric 128. The web 122 is affixed to the cylinder 127 at discrete points corresponding to the knuckles of fabric 128 between pressure roll 140 and cylinder 127 by adhesive from sprayer 130 applied to the cylinder 127 or web 122 immediately prior to the pressure roll 140. The creped thermally predried web 142 is creped from cylinder 127 by doctor blade 144 and reeled onto a roll of finished product 146.

When utilizing a pressure roll 38, or 140 as shown in FIGS. 1 and 2, pressures in the range of from about 50 pli to about 300 pli may sufficiently adhere the web to the dryer at the knuckle areas. A preferable range is 100–200 pli.

FIGS. 1–2 depict a process whereby the same side of the tissue sheet is recreped. It has been found that when utilizing base webs having basis weight between about 6 to 20 pounds per 2880 square feet, such webs produce the most desirable and tactile qualities with a minimum of investment.

Figure 3:
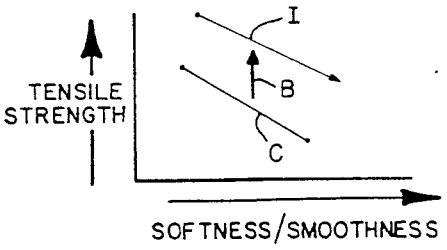
FIG. 3 is a graph generally representing a comparison of the relationship of tensile strength to softness/smoothness of a creped product made in accordance with the present invention and a conventional product.

Typically a tensile strength in the machine direction of at least 1200 grams is necessary for conventionally formed creped consumer tissue products. All creped tissue products exhibit an inverse relationship between tensile strength and softness/smoothness, in that as one increases the strength of the web (thereby having less debonding), one decreases the softness. Likewise, in order to increase softness/smoothness, one must sacrifice strength. FIG. 3 graphically illustrates the advantageous concept of the present invention. According to the invention, it has been discovered that an exceptionally soft yet strong product could be obtained by recreping a previously creped sheet on the same side with an imprinting fabric. In FIG. 3, Curve C represents the tensile strength smoothness/softness relationship for conventional creping techniques. Curve I represents the characteristic of the present invention. It can be seen from the direction of the arrow B that the overall result of the single sided double creping technique of the present invention greatly enhances the resulting product.

It will be appreciated that variations and modifications of the disclosed processes may be effected without departing from the spirit and scope of the novel concepts of this invention.

What is claimed is:

1. A method of making a tissue product comprising:
(a) forming a non-layered wet web of cellulosic fibers having a selected basis weight from an aqueous stock slurry comprising secondary fibers;
(b) partially dewatering said web to remove a portion of the water therein, such that interfiber adhesion is enhanced within said web;
(c) conveying said web to a first drying cylinder and affixing said web to said cylinder such that further interfiber adhesion is effected upon further dewatering to a fiber consistency of at least 90%;
(d) creping said web from the first drying cylinder with a doctor blade, such that said interfiber adhesion is disrupted;
(e) conveying said web to a second drying cylinder and affixing said web thereto at the location of a nip formed between the second cylinder and an imprinting fabric having a pattern of raised knuckle areas thereon;
(f) differentially compressing the web to the second cylinder with said imprinting fabric, said compression resulting in adhesion of said web to said cylinder being greatest in discrete points corresponding to the knuckles of said imprinting fabric;
(g) differentially creping the same side of said web from the second cylinder; and
(h) converting said web into a one-ply or two-ply facial tissue or bath tissue product.

2. The method as recited in claim 1 further comprising adhering the web to the first cylinder at a pressure nip, said pressure nip being formed by a pressure roll.

3. The method as recited in claim 2 further comprising providing the pressure nip with a pressure of about 300–500 pli.

4. The method as recited in claim 2 further comprising providing the pressure nip with a pressure of about 100–300 pli.

5. The method as recited in claim 1, further comprising imprinting said web with an imprinting fabric having a mesh size of from 20 meshes/in$^2$ to 200 meshes/in$^2$.

6. The method as recited in claim 1, further comprising imprinting said web with an imprinting fabric having a mesh size of from 50 meshes/in$^2$ to 100 meshes/in$^2$.

7. The method as recited in claim 1, further comprising adhering the web to the second cylinder at a second pressure nip, said pressure nip being formed by an imprinting fabric wrapped around a pressure roll and a portion of the second cylinder.

8. The method as recited in claim 7, further comprising providing said second pressure nip with a pressure from about 50 pli to 300 pli.

9. The method as recited in claim 8, further comprising providing said pressure nip with a pressure of about 100–200 pli.

10. The method as recited in claim 1, further comprising partially wrapping said impression fabric around said second cylinder without the use of a pressure roll.

11. The method as recited in claim 1, further comprising creping said web from the second cylinder when said web has been dried to a consistency of at least 90%.

12. The method as recited in claim 1, further comprising adhering said web to the second cylinder by applying adhesive to at least one of said cylinder and web prior to adhesion of said web to the second cylinder.

13. The method as recited in claim 12, further comprising applying said adhesive by spraying.

14. The method as recited in claim 12, further comprising applying said adhesive by use of a rotogravure roll.

15. The method as recited in claim 12 wherein the adhesive is at least one of polyvinyl acetate and polyvinyl alcohol.

16. The method as recited in claim 15 wherein said adhesive is less than 1% active adhesive agent.

17. The method as recited in claim 16 wherein said adhesive is between 0.2 and 0.6% active adhesive agent.

18. The method as recited in claim 15 wherein the adhesive is at a concentration of 0.2–1%.

19. The method as recited in claim 15 wherein the adhesive is at a concentration of 0.4–5%.

20. The method as recited in claim 1, further comprising providing said first drying cylinder as a steam heated Yankee dryer, said web being thermally dried by adhesion to said dryer.

21. A tissue product comprising at least one non-layered recreped ply containing secondary fiber.

22. The tissue product of claim 21 wherein the amount of secondary fiber is from about 40 to about 60 weight percent of the total fiber content.

23. The tissue product of claim 21 wherein the amount of secondary fiber is from about 25 to 100 weight percent of the total fiber content.

24. The tissue product of claim 21 consisting of a single ply.

25. The tissue product of claim 21 consisting of two plies, wherein both plies are non-layered recreped plies.

* * * * *

UNITED STATES PATENT AND TRADEMARK OFFICE

CERTIFICATE OF CORRECTION

PATENT NO. : 4,894,118
DATED : January 16, 1990
INVENTOR(S) : Steven L. Edwards et al.

It is certified that error appears in the above-identified patent and that said Letters Patent is hereby corrected as shown below:

Column 2,
Line 48, delete "5%" and substitute -- .5% -- therefor.

Claim 19,
Line 2, delete "5%" and substitute -- .5% -- therefor.

Signed and Sealed this

Twentieth Day of November, 2001

*Attest:*

Nicholas P. Godici

*Attesting Officer*

NICHOLAS P. GODICI
*Acting Director of the United States Patent and Trademark Office*